United States Patent [19]

Doubt

[11] Patent Number: 4,696,842

[45] Date of Patent: Sep. 29, 1987

[54] CUSTOM MOLDABLE HAND GRIP

[76] Inventor: Ruxton C. Doubt, Rte. 1, Box 414, Vashon, Wash. 98070

[21] Appl. No.: 844,084

[22] Filed: Mar. 26, 1986

[51] Int. Cl.[4] ..... A63B 49/08

[52] U.S. Cl. ..... 428/40; 428/423.1; 273/73 J; 273/75

[58] Field of Search ..... 273/73 J, 75; 428/40–42, 423.1

[56] References Cited

U.S. PATENT DOCUMENTS

| | | | |
|---|---|---|---|
| 412,479 | 10/1889 | Davis . | |
| 2,092,909 | 9/1937 | Daniels . | |
| 2,628,100 | 2/1953 | Beebe . | |
| 3,813,729 | 6/1974 | Szabo et al. . | |
| 3,848,480 | 11/1974 | Oseroff et al. . | |
| 3,915,782 | 10/1975 | Davis et al. . | |
| 3,950,838 | 4/1976 | Oseroff et al. . | |
| 3,972,528 | 8/1976 | McCracken et al. . | |
| 4,015,851 | 4/1977 | Pennell . | |
| 4,053,676 | 10/1977 | Kaminstein . | |
| 4,174,109 | 11/1979 | Gaiser . | |
| 4,385,024 | 5/1983 | Tansill . | |
| 4,397,701 | 8/1983 | Johnson et al. . | |
| 4,438,925 | 3/1984 | Lindstrom . | |
| 4,555,113 | 11/1985 | Shimayaki et al. | 273/DIG. 23 X |
| 4,591,155 | 5/1986 | Adachi | 273/67 A |

FOREIGN PATENT DOCUMENTS

| | | | |
|---|---|---|---|
| 2746168 | 4/1979 | Fed. Rep. of Germany . | |
| 2493710 | 11/1980 | France . | |
| 2485934 | 1/1982 | France | 273/73 J |
| 20738 | of 1896 | United Kingdom . | |
| 27827 | of 1898 | United Kingdom . | |
| 211792 | 2/1924 | United Kingdom | 273/73 J |
| 1396424 | 6/1975 | United Kingdom | 273/73 J |

OTHER PUBLICATIONS

The Sporting Goods Dealer, pp. 147, 183.

Kraton, Thermoplastic Rubber Crumb., Publication of the Shell Co., pp. 1–43.

*Primary Examiner*—Nancy A. Swisher

*Attorney, Agent, or Firm*—Seed and Berry

[57] ABSTRACT

A moldable article is described for individualizing the operative surfaces of implements such as the hand grip of tennis racquets or hand tools. The moldable article is a sheet of polymeric material, including a polyurethane or thermoplastic-rubber copolymer component blended with volatile solvents and fillers to form a moldable mass that after receiving an individual's hand impression, for example, cures by solvent evaporation at ambient temperatures to a solid non-tacky hand grip. The moldable article is made by mixing the components together and forming a sheet which is sandwiched between semipermeable films that permit partial evaporation of the solvents. The sheet is then packaged between non-permeable films which prevent further evaporation until impressed by the consumer and exposed to air drying.

21 Claims, 4 Drawing Figures

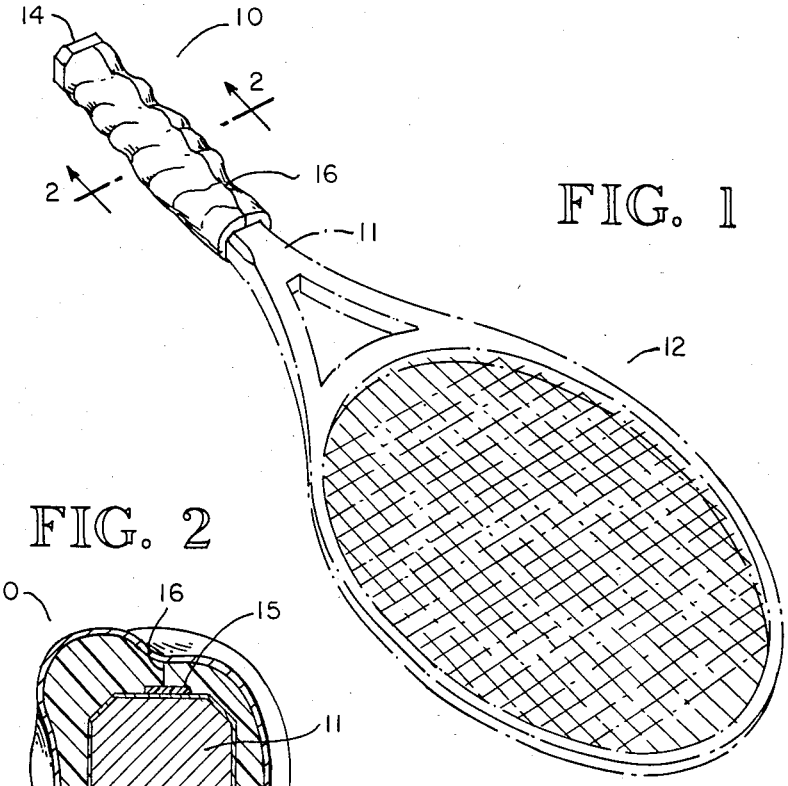
FIG. 1
FIG. 2
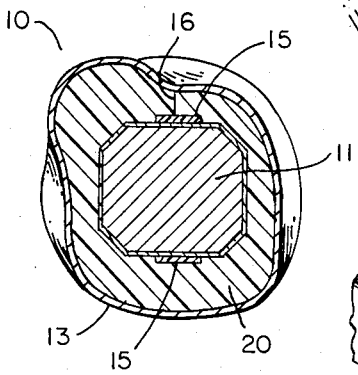
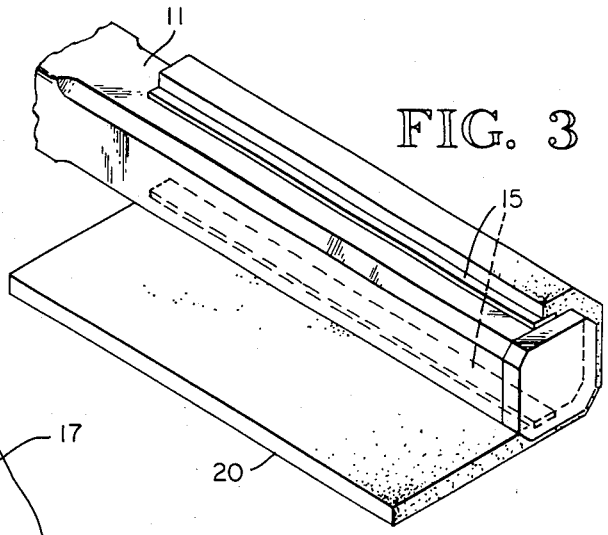
FIG. 3
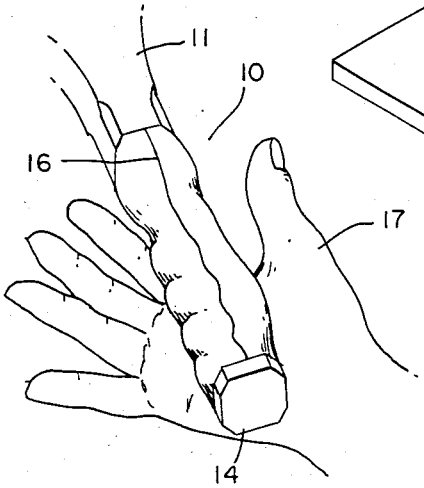
FIG. 4

CUSTOM MOLDABLE HAND GRIP

DESCRIPTION

1. Technical Field

The invention relates to a moldable article that may be adhered to, for example, hand grips of tennis racquets, golf clubs, hand tools, or substantially any implement that is operated by means of contact with an individual. More particularly the invention relates to a hand grip that is adaptable by the individual consumer to an implement having a handle or hand gripping surfaces.

2. Background Art

Many sports activities such as tennis or golf utilize racquets or clubs where the quality of the grip a player is able to establish with the implement determines to a great extent the player's performance. The same relationship between grip and performance is true for many other everyday articles, such as hand tools that have handles or other surfaces that must be firmly but comfortably gripped. Since each individual has a unique hand shape, not every grip provided on mass produced articles today is suitable for every individual. Almost all hand-operated tools could be more satisfactorily utilized if the gripping surfaces of the tool could be molded to the individual operator's hand shape.

In the past, a few early inventors attempted to provide hand grips for golf clubs and the like that could be molded by the consumer on the implement to the individual user's hand. For example, Cauch-Kavanagh in British Pat. No. 20,738 (1896), describes a moldable handle for a golf club made of gutta percha and cork dust. In application, the shaft is coated with the molding compound and the coated handle is submerged in boiling water until it becomes soft and plastic. The user grips the club to squeeze-in his hand impression. The handle is then immersed in cold water which hardens the grip for use. Davis, in U.S. Pat. No. 412,479 (1889), describes a handle material suitable for molding by the user. The handle compound is described as susceptible to softening and becoming plastic at elevated temperatures but not at ambient. It is characterized as a "dental vulcanate" including a soft and a hard component. The material is formed into a sheet and wrapped onto the handle. The handle is then submerged in boiling water or a softening solvent to make the compound plastic. The user then squeezes the handle and the handle solidifies on cooling or evaporation of solvent.

The older products and processes do not utilize modern day polymers and formulations. The old products and processes, typical of those described above, require heating or chemically treating to plasticize the hand grip followed by the user gripping the hot or solvated handle. These processes proved impractical, being messy, as well as somewhat risky, requiring dipping of the handle of an elongated implement into a boiling water or softening chemical solvent bath to soften the material for molding.

Much of the more recent work has involved producing hand grips that are not moldable to the individual hand of the consumer but include a "soft feel" through minor deformation of the grip. For example, Kaminstein in U.S. Pat. No. 4,053,676 describes a material for wrapping around a golf club or tennis racquet handle. The wrapping material includes a foam layer component that deforms in response to an individual's grip.

Oseroff et al. in U.S. Pat No. 3,848,480 and U.S. Pat. No. 3,950,838 describes a tape, suitable for winding onto various gripping surfaces, that is made from a thermoplastic-rubber polymer material. In the Oseroff et al. process, the thermoplastic-rubber material is extruded from a melt to form a finished gripping tape. The grip material formulation is designed to achieve a particular range of hardness, tear resistance and modulus of elongation to provide a soft feel to the user. Oseroff et al. in U.S. Pat. No. 3,950,838 describes solvent processing a thermoplastic-rubber to provide a compound suitable for dipping hand tools and the like to form a grip coating of 0.1–0.5 millimeters thick. The grip is air dried at room temperature.

None of these more recent inventions provide the consumer with a means for adapting a hand tool or sporting implement to the individual user's unique hand shape.

3. Disclosure of the Invention

It is an object to the present invention of provide a moldable article that can be adhered by the consumer to substantially individualize the implement's operative surfaces. The article is particularly useful for individualizing any hand operated implement or an implement that has gripping surfaces where an improved grip on the implement by the user would be of benefit. It is an object of the invention to provide a moldable article that is simple to custom impress and cures safely by means of solvent evaporation at room temperature. The moldable article of the invention avoids the use of elevated softening temperatures or contact with chemical solvent solutions, yet achieves a permanent non-tacky, slightly resilient, gripping surface molded to the individual's hand, for example.

It is an object of the invention to provide a process for producing a moldable article that maintains its moldable state until fitted by the consumer to an implement operative surface, receives an impression of the consumer and thereafter cures into a permanent, individualized molded contact or control surface.

A preferred product of the invention is a moldable hand grip article adaptable to substantially any hand-operated implement having a gripping surface. The article of the invention includes a sheet of moldable polymeric material that is adhesively attachable to substantially cover the implement gripping surfaces. The sheet is of sufficient thickness to produce a molded hand grip of a desired depth. The moldable polymer article is a polymer sheet that is partially solvated by means of a volatile solvent. The moldable sheet is sealed between thin film layers which prevent evaporation of solvent until the article is ready for use. To utilize the article of the invention, the consumer removes one film layer and attaches the exposed sheet surface to the implement gripping surface. The second flim is removed and the consumer squeezes his/her hand into the moldable sheet. The hand grip molding is then allowed to cure by solvent evaporation to a permanent, non-tacky molding retaining the shape of the individual's hand impression.

A suitable polymer component of the moldable polymer material of the invention is a polyurethane. A preferred polymer is a thermoplastic rubber copolymer wherein said thermoplastic is styrene and the rubber is butadiene, ethylene/butylene or isoprene. The most preferable molding compound formulation includes styrene-ethylene/butylene-styrene block copolymer, suitable volatile solvents and fillers to achieve a dough-like consistency for molding. The formulation of the invention dries and cures within a 24-hour period into the desired rigid, slightly resilient, non-tacky individualized molding.

In the process for making the moldable article of the invention, the polymer, in a granulated or particulate form is dissolved in the selected solvents to produce a solution. A second portion of polymer material and fillers are added to the solution. The mixture is stirred and kneaded until a uniform mixture is produced having the desired dough-like consistency. The material is then formed into a sheet of suitable dimensions. The sheet is sandwiched between two films which are semipermeable with respect to evaporation of solvent, but exclude oxygen and prevents rapid drying at the surfaces of the sheet. Solvent evaporation through the films is allowed to continue until the sheet has, uniformly throughout its mass, lost that portion of the solvent unnecessary for the subsequent impression step. The now less than saturated sheet is sandwiched between films that prevent further evaporation of solvents. The sheet material is then packaged in this partially cured form for use by the consumer.

BRIEF DESCRIPTION OF THE DRAWINGS

FIG. 1 depicts a racquet which includes the permanently molded polymeric hand grip handle covering embodiment of the invention molded to an individual's hand grip.

FIG. 2 is a cross sectional view of the cured molding of the invention taken along sectional line 2—2 of FIG. 1.

FIG. 3 shows the moldable sheet material of the invention in the process of installation on the racquet handle of FIG. 1.

FIG. 4 shows an individual releasing the moldable material after forming an impression on the hand grip of the racket of FIG. 1.

BEST MODE FOR CARRYING OUT THE INVENTION

As shown in FIG. 1, an embodiment of the invention is a finished custom molding in the form of a permanent personal, hand grip molding 10 affixed to the handle 11 of, for example, a tennis racquet 12. The grip 10 of the invention is suitable for installation by a consumer and improves the operating grip of any implement such as a racquet, golf club, baseball bat, oars and the like. The grip is also useful for improving the grip of hand tools such as hammers, saws, axes, or substantially any implement that has a hand grip surface where gripping is important to control the implement or simply makes utilization more comfortable. The hand grip produced by means of the present invention retains the shape of a hand impression permanently. The gripping surface is smooth, having a rubbery-type give or feel, but remains firm and dimensionally stable at any ambient temperature. The cured hand grip material may include a degree of foam structure in the form of scattered closed gas cells, the presence of which is generally desirable since it adds to the soft feel of the grip.

The hand grip material is provided to the consumer in sheet form, typically as a flat sheet or tubular shape, suitable for fitting to the typical racquet or tool handle. The material is packaged in a solvent-impermeable package in a partially cured form having a dough-like consistency. The sheet material at this stage is somewhat less than saturated with solvent, but is of a consistency that readily receives a hand impression, yet maintains the impression during a subsequent solvent evaporation curing process.

FIG. 2 shows a cross section of the cured molding produced utilizing the molding article of the invention. The hand grip material 20, in cross section, is irregular in shape in conformance with the generally irregular shape of an individualized impression. The cured molding 10 may be wrapped with a cloth 13 or the like to give the handle a more finished appearance. An end piece 14 may also be added to protect the end of the molding 10. The molding may be secured to the handle by means of the inherent adhesiveness of the molding material. Alternatively, an adhesive means, such as double-back tape 15 is employed.

The flat sheet hand grip material is generally received by the consumer cut to a length suitable for the type of grip for the particular implement for which the packaging is intended. For example, in the case of a tennis racquet, the consumer may receive material of sufficient length to impress two adjacent hand grips to accommodate both a backhand and forehand grip. The width of the molding sheet provided is somewhat greater than the largest handle contemplated by the packager so that the consumer will always be able to obtain a complete hand grip on the implement for which the package is intended.

Referring to FIGS. 3 and 4, the flat sheet molding material 20 is fitted with double-backed adhesive tapes 15 for securing the molding to the handle 14 of the racquet. The molding sheet 20 is wrapped about the handle so that the material overlaps. The overlapping edge is pressed down onto the adhesive tape and excess material is cut away to form as clean and even a joint 16 as possible. The covered handle is then gripped by the consumer 17, employing the best or the most comfortable grip suitable for the racquet or implement. The consumer squeezes the molding material until the desired depth of grip impression is formed. The consumer releases the grip and as shown in FIG. 4, the impression remains in the moldable material 20. The molded grip is then allowed to cure by solvent evaporation at room temperature for a time until the finished, fully cured state is achieved. Cure times are preferably within a range of 4–24 hours, and are achieved entirely by ambient air drying.

A principal ingredient of the moldable sheet material of the invention is a polymer or copolymer that cures by solvent evaporation alone. The moldable material formulation, in addition to suitable solvents, includes fillers necessary to give the formulation sufficient bulk and a moldable consistency.

The choice of polymers, fillers and solvents, in combination, determines whether the resulting sheet material will function as intended, including whether the moldable article will have a sufficiently long shelf life, yet cure completely after impression within a period of time acceptable to the consumer.

The preferred polymer component of the invention is a thermoplastic polymer that cures to a permanent non-tacky solid by means of solvent evaporation at ambient temperatures. Thus, the polymer must be soluble in volatile hydrocarbon solvents. The polymer must mix with fillers to provide a moldable mass, but retain an impression sufficiently long to cure.

The preferred polymer of the invention is a thermoplastic-rubber block copolymer. A preferred thermoplastic-rubber block copolymer is a series of copolymers manufactured by Shell Chemical Company of Houston, Tex. under their Kraton® product name. The Kraton polymer is made up of molecular chains consisting of three blocks. The chains include an elastomeric block in the center and thermoplastic blocks on each end of the molecule. The polymer structure permits solvating, forming or casting, followed by drying to a finished, cured state. The thermoplastic component of the Kraton® series is styrene. The elastomeric component may be butadiene, ethylene/butylane or isoprene. The most preferred polymer is a styrene-ethylene/butylene-styrene (S-EB-S) copolymer, Kraton G 1652 and G 1657. Kraton G polymers include saturated rubber midblocks which improves their resistance to degradation by environmental conditions and have higher softening temperatures. Another suitable polymer is a polyurethane.

The solvents that are utilized in making the molding sheet material are key components of the partially cured article received by the consumer and have a great impact on product characteristics and qualities of the moldable article of the invention. The Kraton polymers of interest are soluble in a wide range of hydrocarbon solvents. However, a key consideration in selection of solvents is that the polymer includes separate rubber and styrene phases held together by physical cross-linking. For the preferred S-EB-S polymer, the solvent must solvate both the rubber and styrene phases to permit adequate, uniform mixing of fillers and to achieve a mass having a consistency suitable for forming, as well as later receiving the consumer's hand impression. A factor in selection of solvents is thus their compatibility with both polymer phases. A good solvent for both phases will likely quickly dissolve both polymer phases. However, choice of solvents also impacts drying time. Poor solvents for the polymer phases tend to release easier and their presence in the solvent mixture may result in significantly faster drying times than for those solvents which have faster solution times.

The physical properties of the resulting molding products are also somewhat dependent upon the solvent system employed. The properties will in general be determined by the solvent component which evaporates last in the curing process. If the last solvent to evaporate dissolves the polystyrene phase only, the rubber midblock phase precipitates first. A continuous polystyrene phase network tends to be formed rather than discrete polystyrene domains. The goal of the present invention is to achieve a product that is dimensionally stable and tough after curing, having properties relatively close to those of a conventional but firm rubber.

A principal factor in choosing the solvent system is drying time for the finished product. The preferred formulation is designed to cure completely within 24 hours. For fast drying, it is preferred that relatively poor solvents for the thermoplastic component be utilized to solubilize the thermoplastic phase of the copolymer. A preferred class of compounds are chlorinated hydrocarbons. Of course, these solvents must be carefully selected from those which are safe with respect to human exposure. Suitable solvents are, for example, 1, 1, trichloroethane, methylene chloride, and the like.

The preferred solvent mixture also includes a fast-drying aliphatic hydrocarbon component, which is a good solvent for the rubber phase. A preferred solvent is petroleum naptha. This solvent component helps prevent the moldable sheet product from forming a surface skin through which the solvents would not pass in the curing process.

The bulk and desired consistency of the molding materials is provided by fillers or thickening agents. Suitable fillers include silica and rubber dust. The filler content has a significant impact on cure times. Limiting filler content is generally necessary to achieve reasonably quick cure times. Too much filler results in unacceptably long cure times. The consistency of the mass during processing is also controlled by a staged addition of the principal polymer, as described below. The consistency of the finished sheet material is an important quality of the product, since it permits production of a sheet of adequate thickness to receive and retain a hand grip impression.

A key element of the invention is the process by which the ingredients are combined to produce a partially cured article that can be safely and easily employed by a consumer. The polymer material is conventionally received in a solid, particulate form, for example, as pellets or granulated powder. The process requires initially contacting a first portion of the polymer component and all solvents in a closed mixing vessel. The dissolution time depends upon the solvent system chosen and upon the mixing equipment utilized. The solution process may require up to several hours, producing a relatively non-viscous syrup. In a second step, a final portion of polymer and fillers are mixed into the syrup solution. The ingredients are mixed and kneaded until a uniform mixture of dough-like consistency has been achieved. The mass is then formed into a flat sheet of desired dimensions. The sheet is sandwiched between two semipermeable films that prevents rapid solvent loss at the sheet surfaces, avoiding surface skinning of the sheet, but permits a relatively uniform evaporation of solvent from the entire thickness of the sheet. The solvent is allowed to evaporate until the mass has lost about 15% by weight. The sheet is subsequently sealed between non-permeable films that prevent further evaporation of solvent. The sheet material is now in the finished, partially cured form and is appropriately packaged for the consumer.

EXAMPLE

A formulation of the invention suitable for cure after impression within 4–5 hours was made by the process described above. The formula includes:

Solution Components 182 g 1, 1, 1 trichloroethane
108 g petroleum naphtha
185 g methylchloride
90 g Kraton G 1657
35 g Kraton G 1652.

Mixture Additives

10–30 g rubber dust
7–15 g Cabosil Silica
70–105 g Kraton G 1652.

The three solvents and the two Kraton G components were mixed together in a closed tank and allowed to sit for four hours forming the syrup-like solution. The mixture additives were then added, including a second component of 70–105 g of Kraton G. Also added was 10–30 grams of rubber dust ground to 35 mesh and 7–15 grams of Cabosil silica. After kneading to a uniform mixture, the mixture was ram-extruded and sandwiched between films of low-density polyethylene. The film permitted evaporation of solvent from the sheet and the evaporation process was allowed to continue until the sheet had lost 15% by total weight. The finished product was then sandwiched between mylar film which halted evaporation and the product was then employed to produce a molding as shown in FIG. 1. Complete cure of the molding was achieved within 4–5 hours.

As discussed above, the choice of solvents has a significant impact upon moldable article product qualities and its process of manufacture. The 1, 1, 1 trichloroethane solvent dissolves the preferred Kraton polymer at room temperature. Other solvents are also suitable. For example, toluene might be chosen, if the application of heat and increased mixing energy were acceptable processing requirements. Methylene chloride is present in the solvent mixture to help speed cure times. Suitable substitutes might include betones such as methyl ethyl betone, for example.

It is clear that the moldable article of the invention is useful for individualizing the control or operative surfaces of any implement that includes an interface or contact between the implement and the individual. The implements and contact surfaces are not limited to hand operated devices and hand grips. For example, it is obvious that the moldable article is useful as a shoe sole insert or insole.

From the foregoing, it will be appreciated that, although embodiments of the invention have been described herein for purposes of illustration, various modifications may be made without deviating from the spirit and scope of the invention. Accordingly, the invention is not limited except as by the appended claims.

I claim:

1. A moldable article, for individualizing the hand grip surface of an implement, said article comprising:

a sheet of dripless, dough-like moldable polymeric material pliable at room temperature, and wrapable around the hand grip surface of the implement to substantially cover the hand grip surface, said sheet having opposed end portions positionable together in generally end-to-end relationship, said sheet being of sufficient thickness to form a molded impression therein of a desired depth upon the intended user of the implement grasping the hand grip surface with said sheet therebetween, said moldable polymer material including a polymer, partially solvated by a volatile solvent into a moldable mass, said material having a consistency sufficiently soft to readily accept the impression under normal hand-applied pressure and sufficiently firm to permit handling prior to formation of the impression without significant deformation and to hold the impression immediately upon its formation and as evaporation of said solvent occurs without the intended user continuing to grasp the hand grip surface, said sheet being covered by at least one removable film layer covering an outward facing surface of said sheet and preventing evaporation of said solvent prior to formation of the impression, said sheet allowing gradual evaporation of said solvent after removal of said film layer at a rate sufficiently slow to allow formation of the impression into said sheet, and upon sufficient evaporation of said solvent curing into a permanent molding retaining the impression.

2. The moldable article of claim 1 wherein said moldable polymer material comprises a thermoplastic polymer or copolymer, partially dissolved in a volatile solvent, and fillers.

3. The moldable article of claim 2 wherein said moldable polymer is a polyurethane.

4. The moldable article of claim 2 wherein said polymer is a thermoplastic-rubber copolymer wherein said thermoplastic is styrene and said rubber is selected from the group consisting of butadiene, ethylene/butylene and isoprene.

5. The moldable article of claim 2 wherein said thermoplastic rubber block copolymer is styrene-ethylene/-butylene-styrene.

6. The moldable article of claim 2 wherein said volatile solvent is a mixture of components selected from the group consisting of 1,1,1 trichloroethane, methylene chloride, toluene, methyl ethyl ketone and petroleum naphtha.

7. The moldable article of claim 2 wherein said volatile solvent is a mixture of 1, 1, 1 tychloroethane, methylene chloride and petroleum naphtha, present in about a 1:1:1 ratio.

8. The moldable article of claim 1 wherein said sheet of moldable material is adhered to said implement surfaces by means of double-sided adhesive tape having an inward adhesive side adherable to the hand grip surface and an outward adhesive side facing outward for adhering to an inward facing surface of said sheet.

9. The moldable article of claim 1 wherein said sheet of moldable material is adhered to said implement surfaces by means of a spray adhesive.

10. The moldable article of claim 8 wherein said sheet end portions are overlaying and adhesively engaged with said tape outward side.

11. The moldable article of claim 1 wherein the implement is a racquet or club suitable for sporting activities.

12. The moldable article of claim 1 wherein the implement is a hand tool.

13. In a hand operated implement having an elongated hand grip surface and a hand grip positioned thereon, the improvement wherein said hand grip can be individualized with said hand grip comprising:

a sheet of dripless, dough-like moldable polymeric material pliable at room temperature, wrapped around the hand grip surface of the implement and substantially covering the hand grip surface, said sheet having opposed end portions positionable together in generally end-to-end relationship, said sheet being retained against longitudinal movement along the hand grip surface and of sufficient thickness to form a molded impression therein of a desired depth upon the intended user of the implement grasping the hand grip surface with said sheet therebetween, said moldable polymer material including a polymer, partially solvated by a volatile solvent into a moldable mass, said material having a consistency sufficiently soft to readily accept the impression under normal hand-applied pressure and sufficiently firm to permit handling prior to formation of the impression without significant deformation and to hold the impression immediately upon its formation and as evaporation of said solvent occurs without the intended user continuing to grasp the hand grip surface; and at least one removable film layer covering an outward facing surface of said sheet and preventing evaporation of said solvent prior to formation of the impression, said sheet allowing gradual evaporation of said solvent after removal of said film layer at a rate sufficiently slow to allow formation of the impression into said sheet, and upon sufficient evaporation of said solvent curing into a permanent molding retaining the impression.

14. The hand operated implement of claim 13, the improvement further including adhesive means for adhering to the hand grip surface of the implement and providing an adhesive outward facing surface, and wherein said sheet is positionable on the hand grip surface with both end portions overlaying and adhesively engaged with said adhesive surface to adhere said sheet to the hand grip surface.

15. The hand operated implement of claim 14 wherein said adhesive means comprises a double-sided adhesive tape having an inward adhesive side adhered to the hand grip surface and an outward adhesive side facing outward to provide said adhesive surface.

16. An implement with a hand grip on a handle portion thereof which can be individualized by the intended user of the implement, the implement produced by:

applying a double-sided adhesive tape having an inward side and an outward side, with said inward side of said tape adhered to the handle portion;

wrapping a sheet of dripless, dough-like moldable polymeric material pliable at room temperature around the implement handle portion, said sheet having a length in a first direction as great as the exterior circumference of the implement handle portion and a length in a second direction as great as the width of the hand grip desired, said sheet being wrapped lengthwise in said first direction around the implement handle portion with an inward surface of said sheet facing inward to cover the handle portion, and with a pair of opposed end portions of said sheet which are spaced apart in said first direction having mating opposed ends positioned in a generally end-to-end relationship with both said ends overlaying said tape and adhered to said outward side of said tape, said sheet having sufficient thickness for formation of a molded impression therein of a desired depth upon the intended user grasping the implement handle portion with said sheet therebetween, said sheet material including a polymer partially solvated by a volatile solvent into a moldable mass, said sheet material having a consistency sufficiently soft to readily accept the impression under normal hand-applied pressure and yet sufficiently firm to permit handling prior to formation of the impression without significant deformation and to hold the impression immediately upon its formation and as evaporation of said solvent occurs without the intended user continuing to grasp the implement handle portion, said sheet material allowing evaporation when exposed to the atmosphere at a rate sufficiently slow to allow formation of the impression and upon sufficient evaporation curing into a permanent molding retaining the impression; and covering an outward surface of said sheet with a removable, generally nonpermeable film layer to substantially prevent evaporation of said solvent from said sheet material prior to formation of the impression.

17. The implement of claim 16 produced by the further steps of:

removing said film layer to expose said sheet to the atmosphere to evaporate said solvent;

grasping the implement handle portion by the hand of the intended user with said sheet wrapped around the handle portion;

applying sufficient pressure on said sheet with the hand of the intended user to produce the impression at the desired depth; and allowing said solvent to evaporate to atmosphere until sufficient evaporation has occurred to cure said sheet material into said permanent molding retaining the impression.

18. The implement of claim 17 produced by the further step of releasing the grasp of the implement handle portion by the hand of the intended user once the impression is made at the desired depth without waiting for evaporation to produce curing of said sheet material.

19. A kit usable at home for replacement of an original equipment hand grip on a handle portion of an implement with an individualized hand grip, the kit comprising:

a sheet of dripless, dough-like moldable polymeric material pliable at room temperature and wrapable around the hand grip surface of the implement to substantially cover the hand grip surface, said sheet having opposed end portions positionable together in generally end-to-end relationship with both end portions, said sheet being of sufficient thickness to form a molded impression therein of a desired depth upon the intended user of the implement grasping the hand grip surface with said sheet therebetween, said moldable polymer material including a polymer, partially solvated by a volatile solvent into a moldable mass, said material having a consistency sufficiently soft to readily accept the impression under normal hand-applied pressure and sufficiently firm to permit handling prior to formation of the impression without significant deformation and to hold the impression immediately upon its formation and as evaporation of said solvent occurs without the intended user continuing to grasp the hand grip surface; and at least one removable film layer covering an outward facing surface of said sheet and preventing evaporation of said solvent prior to formation of the impression, said sheet allowing gradual evaporation of said solvent after removal of said film layer at a rate sufficiently slow to allow formation of the impression into said sheet, and upon sufficient evaporation of said solvent curing into a permanent molding retaining the impression.

20. The kit of claim 19 further including a double-sided adhesive tape having an inward adhesive side adherable to the hand grip surface of the implement and an outward adhesive side facing outward, said sheet being adherable to the implement by said tape.

21. The kit of claim 20 wherein said sheet end portions are positionable overlaying said outward adhesive side of said tape to adhere said sheet end portions to the implement.

* * * * *